US008511803B2

(12) United States Patent
Wang et al.

(10) Patent No.: US 8,511,803 B2
(45) Date of Patent: Aug. 20, 2013

(54) CARTRIDGE FOR INK-JET PRINTER

(75) Inventors: Guilian Wang, Guangdong (CN); Xiaotian Ma, Guangdong (CN)

(73) Assignee: Ninestar Image Co., Ltd., Zhuhai (CN)

( * ) Notice: Subject to any disclaimer, the term of this patent is extended or adjusted under 35 U.S.C. 154(b) by 0 days.

(21) Appl. No.: 12/866,173

(22) PCT Filed: Nov. 30, 2009

(86) PCT No.: PCT/CN2009/075222

§ 371 (c)(1),
(2), (4) Date: Aug. 4, 2010

(87) PCT Pub. No.: WO2010/075718

PCT Pub. Date: Jul. 8, 2010

(65) Prior Publication Data

US 2011/0249064 A1 Oct. 13, 2011

(30) Foreign Application Priority Data

Dec. 31, 2008 (CN) ..... 2008 1 0241936

(51) Int. Cl.
*B41J 2/175* (2006.01)
*B41J 29/393* (2006.01)

(52) U.S. Cl.
USPC ..... 347/86; 347/6; 347/19; 347/29; 347/85

(58) Field of Classification Search
CPC ..... B41J 2/1755; B41J 2/17543
USPC ..... 347/86
See application file for complete search history.

(56) References Cited

U.S. PATENT DOCUMENTS

| | | | | |
|---|---|---|---|---|
| 4,500,894 | A * | 2/1985 | Kirner | 347/29 |
| 2009/0160918 | A1* | 6/2009 | Sugahara | 347/86 |
| 2011/0292138 | A1* | 12/2011 | Ma | 347/86 |

FOREIGN PATENT DOCUMENTS

JP 2007136746 A * 6/2007

* cited by examiner

*Primary Examiner* — Shelby Fidler
(74) *Attorney, Agent, or Firm* — Jackson IPG PLLC

(57) ABSTRACT

The invention relates to a cartridge for ink-jet printer, comprising a cartridge body, a protective cover moving relatively to the cartridge body under pressure, a detection mechanism for cartridge and a detection mechanism for remaining ink volume, wherein the detection mechanism for cartridge includes the first and second detecting units respectively matching to the first and second sensors on the printer. The said second detecting unit includes a shelter unit, a fixed shaft set on the cartridge body, a sliding shaft on the protective cover and a reset unit of the shelter unit, wherein the shelter unit connects with the rotating shaft of the fixed shaft, rotates around the fixed shaft under the pressure of the sliding shaft and resets together with the protective cover under the effect of the reset unit of the shelter unit. It is the shelter unit rather than the movable lever at the middle of the detection mechanism for remaining ink volume that finally shelters from the light emitted by the emission unit of the second sensor, so it will not be influenced by remaining ink volume.

9 Claims, 6 Drawing Sheets

CARTRIDGE FOR INK-JET PRINTER

BACKGROUND OF THE INVENTION

1. Field of the Invention

The invention relates to a cartridge for ink-jet printer.

2. Description of the Related Art

The existing cartridge matching to ink-jet printer includes a cartridge body, a protective cover moving relatively to the cartridge body under pressure, a detection mechanism for cartridge and a detection mechanism for remaining ink volume, wherein the cartridge body includes an ink storage cavity, an ink outlet for providing ink to the printer head and an air inlet. The cartridge must include two detection mechanisms in order to ensure the normal operation of cartridge after installed in the printer. During the installation process of cartridge on the printer, one detection mechanism at first prevents the light from the emission unit of the second sensor from returning to the reception unit of the second sensor, and then allows such light to return to the reception unit of the second sensor. After that, the other detection mechanism prevents the light from the emission unit of the first sensor from returning to the reception unit of the first sensor, and finally, the light from the reception unit corresponding to the first and second sensors is prevented from returning to corresponding reception unit. Installation detection is completed after that. Then the printer gives a prompt that cartridge installation is completed to go to the next operation. The mechanism of the existing cartridge for detecting cartridge and ink volume is shown as FIG. 1, comprising the first detecting unit a, the second detecting unit b, the third detecting unit c, a light transmission unit d and a movable lever e. The detection mechanism of this plan is realized by sheltering the light from sensor, whereof the operating principle is as follows: when cartridge is installed in the printer, the light from the second sensor in the printer is sheltered by the second lightproof detecting unit b initially and then connected without the shelter of the second lightproof detecting unit b with the installation of cartridge. After that, the light from the first sensor is sheltered by the first detecting unit a, and finally the light from the second sensor is also sheltered by the third lightproof detecting unit c, whereafter the printer gives a prompt of the existence of cartridge for the next operation. The said third detecting unit c is comprised of a light transmission unit d and a lightproof movable lever e, the position of the latter may vary with the ink volume in the cartridge, and the light from the second sensor can detect the ink volume in the cartridge according to the fact whether the light is sheltered by the third detecting unit c. From the above, it is clear that the installation detection for cartridge must use the detection mechanism for remaining ink volume, the sheltering of the third detecting unit in another word, to realize that the installation detection for cartridge shall not be completed independently without the influence of remaining ink volume. For example, when the installation of cartridge without ink is completed, installation is completed in actual, but the printer may give a prompt that installation is not completed, resulting that the alarming of installation incompletion and of no ink can not be distinguished definitely.

SUMMARY OF THE INVENTION

It is, inter alia, an object of the invention to provide a cartridge for ink-jet printer to resolve the technical problem existing in the installation detection of cartridge in ink-jet printer that the installation detection of cartridge can not be completed independently without the detection mechanism of remaining ink volume and shall be influenced by remaining ink volume.

In order to solve the above technical problem, the invention is to take a technical plan, comprising:

A cartridge for ink-jet printer comprising a cartridge body, a protective cover moving relatively to the cartridge body under pressure, a detection mechanism for cartridge and a detection mechanism for remaining ink volume, wherein the said cartridge body includes an ink storage cavity, an ink outlet for providing ink to the printer head and an air inlet. The said detection mechanism of cartridge includes the first and second detecting units respectively matching to the first and second sensors on the printer, characterized in that the said second detecting unit includes a shelter unit, a fixed shaft set on the cartridge body, a sliding shaft on the protective cover and a reset unit of the shelter unit, wherein the said shelter unit connects with the rotating shaft of the fixed shaft, rotates around the fixed shaft under the pressure of the sliding shaft and resets together with the protective cover under the effect of the reset unit of shelter unit.

The said reset unit of shelter unit is the shifting chute of the sliding shaft set on the shelter unit.

The said reset unit of the shelter unit is the spring set between the fixed shaft and the shelter unit.

The said detection mechanism for remaining ink volume includes a trigger switch set in the cartridge body and a lamp connected in series with the trigger switch, wherein the said lamp is set in the space near the reception unit of the second sensor and connects with the power supply, and the said trigger switch is in disconnection when there's ink and in connection when there's no ink.

The said detection mechanism for remaining ink volume includes a trigger switch set in the cartridge body and a alarming mechanism connected in series with the trigger switch, wherein the said alarming mechanism connects with the power supply and the trigger switch is in disconnection when there's ink and in connection when there's no ink.

The said detection mechanism for remaining ink volume includes a cavity made of transparent material and connected with the ink storage cavity.

The said trigger switch is set at the bottom of the ink storage cavity.

The said trigger switch is set on both sides of the ink storage cavity, wherein one side has elasticity, stretching to turn off the trigger switch when there's ink and retracting to turn on the trigger switch when there's no ink.

The said cavity has a movable detecting unit floating in the ink.

The transparent wall of the cavity has a mark showing ink volume.

After adopting the above technical plan, as the second detecting unit includes a shelter unit, a fixed shaft set on the cartridge body, a sliding shaft on the protective cover and a reset unit of the shelter unit, the shelter unit connects with the rotating shaft of the fixed shaft, rotates around the fixed shaft under the pressure of sliding shaft and resets together with the protective cover under the effect of the reset unit of shelter unit. It is the shelter unit rather than the movable lever at the middle of the detection mechanism for remaining ink volume that finally shelters from the light emitted by the emission unit of the second sensor, so it will not be influenced by remaining ink volume, which solves the technical problem existing in the installation detection of cartridge in ink-jet printer that the installation detection of cartridge can not be completed independently without the detection mechanism of remaining ink volume and shall be influenced by remaining ink volume, realizing full separation of installation alarming and no ink alarming. Secondly, in view of the fact that the detection mechanism for remaining ink volume includes a trigger switch set in the cartridge body and a lamp connected in series with the trigger switch, wherein the said lamp is set on the side of the shelter unit near the second sensor and connects with the power supply and the said trigger switch is in disconnection when there's ink and in connection when there's no ink, complex lever structure is removed, the trigger switch with superior accuracy is used to detect remaining ink volume accurately, and the cartridge of this invention can be used directly without changing the original ink alarming system of the printer, performing the detection of remaining ink volume through controlling the connection condition of the sensor according to relevant lamp. In addition, the said detection mechanism for remaining ink volume includes a trigger switch set within the cartridge body and a alarming mechanism connected in series with the trigger switch, wherein the said alarming mechanism connects with the power supply and the trigger switch is in disconnection when there's ink and in connection when there's no ink, so alarming can be transmitted outward by directly using the alarming mechanism with simple structure and high reliability. Finally, the detection mechanism for remaining ink volume adopts a cavity made of transparent material and connecting with the ink cavity, so user can see remaining ink volume visually just by opening the ink cavity cover of the printer to estimate the use time of the ink left and prepare necessary ink as early as possible. The movable detecting unit floating in the ink is set in the cavity to make observation of remaining ink volume clearer and ink volume mark on the transparent wall of the cavity is set to make observation of remaining ink volume more accurate.

DETAILED DESCRIPTION OF THE PREFERRED EMBODIMENTS

Embodiment 1

Figure 1:
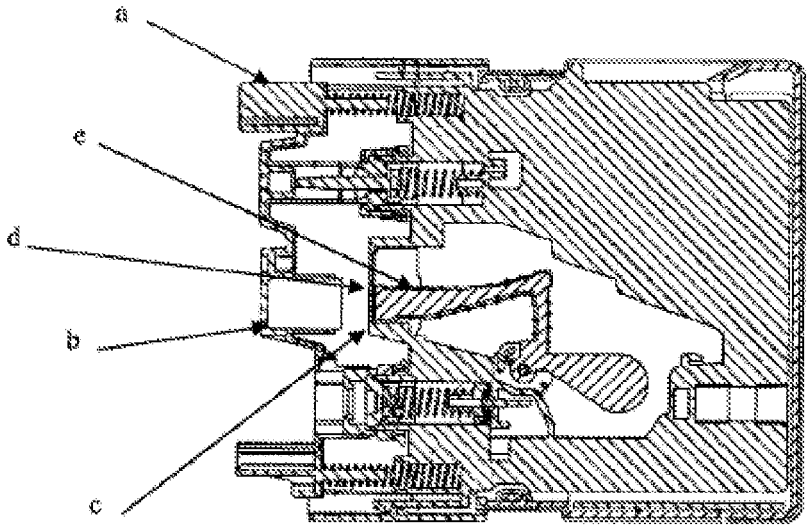
FIG. 1 illustrates a structural diagram of the existing cartridge.
Figure 2:
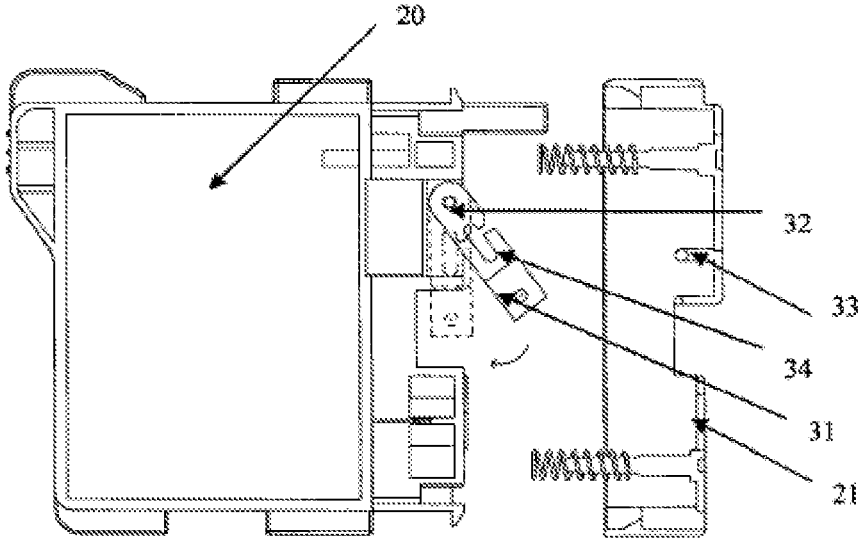
FIG. 2 illustrates a structural diagram for the cartridge of embodiment 1 of the invention.
Figure 3:
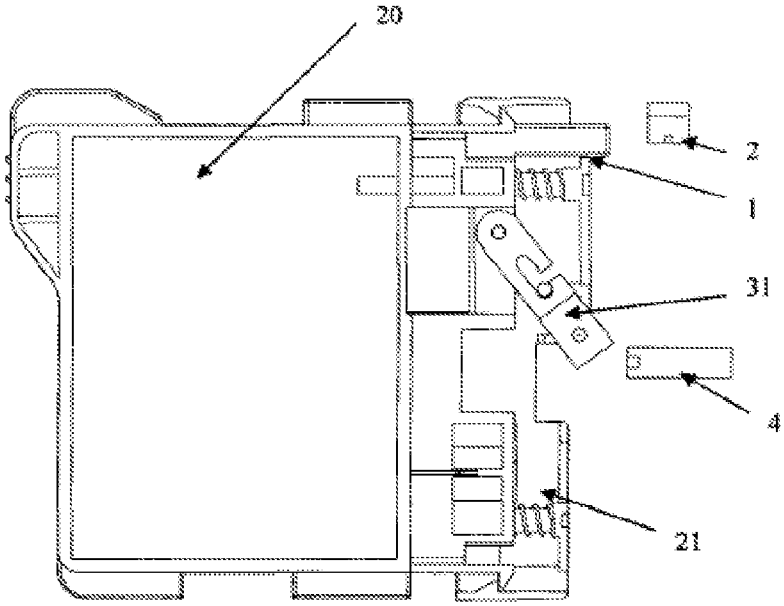
FIG. 3 illustrates a diagram of relative position between the cartridge and the first and second sensors which are connected before the cartridge of embodiment 1 of the invention is installed in the printer.
Figure 4:
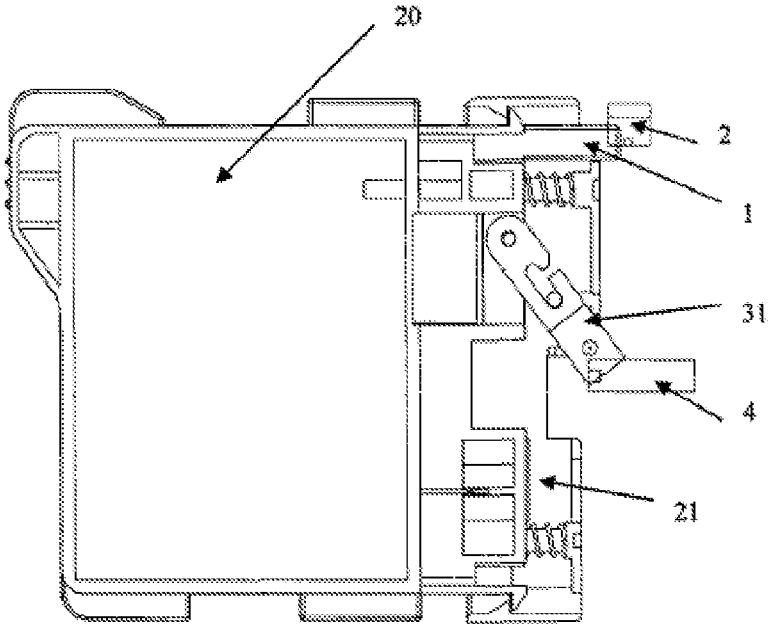
FIG. 4 illustrates a diagram of relative position between the cartridge and the first and second sensors wherein the second sensor is disconnected and the first sensor is connected when the cartridge of embodiment 1 of the invention is just installed in the printer.
Figure 5:
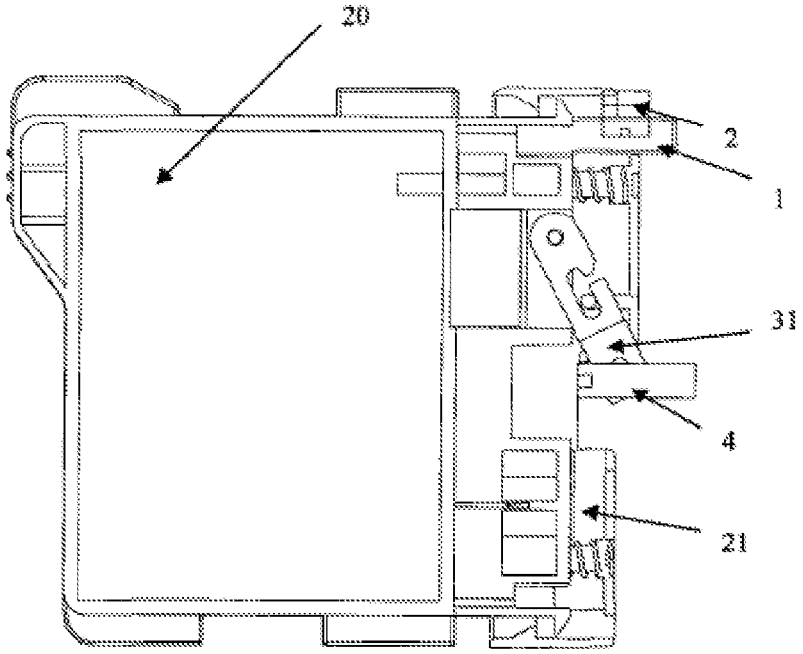
FIG. 5 illustrates a diagram of relative position between the cartridge and the first and second sensors wherein the second sensor is connected and the first sensor is disconnected during the process of installing the cartridge of embodiment 1 of the invention in the printer.
Figure 6:
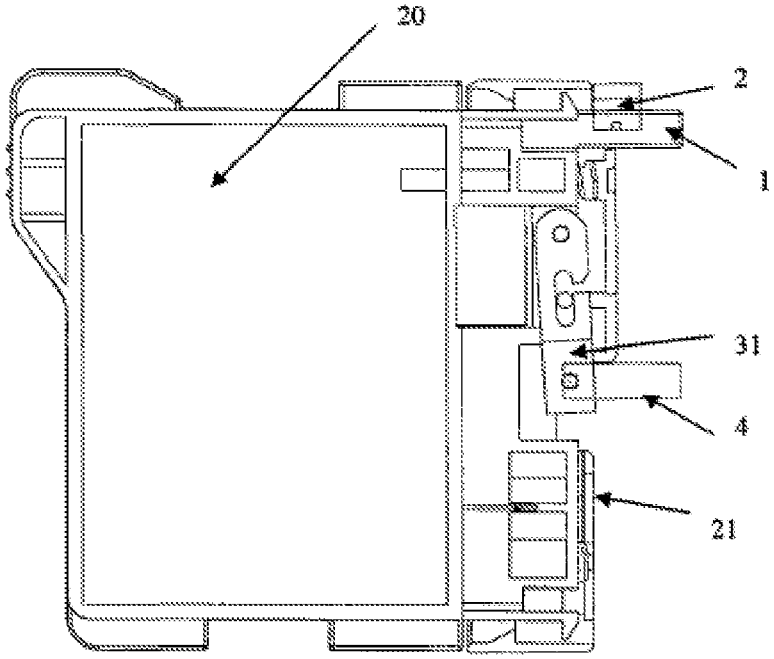
FIG. 6 illustrates a diagram of relative position between the cartridge and the first and second sensors wherein both sensors are disconnected when the cartridge of embodiment 1 of the invention is successfully installed in the printer.
Figure 7:
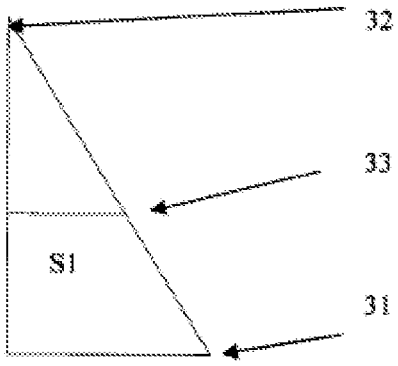
FIG. 7 illustrates a comparison diagram of back-and-forth position moving for the fixed and sliding shaft and the front end of shelter unit in the cartridge of embodiment 1 of the invention.
Figure 8:
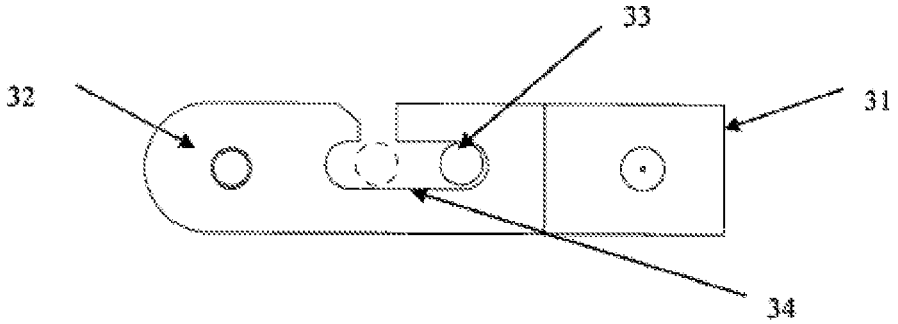
FIG. 8 illustrates a connection diagram of the fixed and sliding shaft, the shifting chute with movable shaft bayonet and the shelter unit in the cartridge of embodiment 1 of the invention.

FIG. 2 shows a cartridge for ink-jet printer, comprising a cartridge body 20, a protective cover 21 moving relatively to the cartridge body under pressure, a detection mechanism for cartridge and a detection mechanism for remaining ink volume, wherein the cartridge body 20 includes an ink storage cavity 5, an ink outlet for providing ink to the printer head and an air inlet, the detection mechanism of cartridge includes the first detecting unit 1 and the second detecting unit respectively matching to the first sensor 2 and second sensor 4 on the printer. The said second detecting unit includes a shelter unit 31, a fixed shaft 32 set on the cartridge body 20, a sliding shaft 33 on the protective cover 21 and a reset unit of the shelter unit, wherein the shelter unit 31 connects with the rotating shaft of fixed shaft 32, rotates around the fixed shaft 32 under the pressure of the sliding shaft 33 and resets together with the protective cover 21 under the effect of reset unit of the shelter unit, the said reset unit of shelter unit is the shifting chute 34 of sliding shaft with bayonet set on the shelter unit 31, and the sliding shaft can enter its shifting chute 34 from the bayonet, the diameter of which is less than that of the sliding shaft by 2-3 mm. The reset unit of the shelter unit can also be realized by setting a spring between the fixed shaft 32 and the shelter unit 31. During the process of installing the cartridge in the printer, both sensors in the printer are in connection shown as FIG. 3; with the installation progress of the cartridge, the protective cover 21 at the front end of the cartridge is moved while the second sensor 4 is started to be connected to emit light from its emission unit, which can not return to the reception unit of the second sensor 4 due to the shelter unit 31, resulting in the light path of the second sensor 4 being disconnected as FIG. 4; the first sensor 2 is not connected to the first detecting unit 1, under connection status. With the further installation of the cartridge, the protective cover 21 at the front end of the cartridge moves in the direction opposite to that of the cartridge to make the sliding shaft 33 fixed on the protective cover 21 move in the shifting chute 34 of the second detecting unit 1. The shelter unit 31 of the second detecting unit moves around the fixed shaft behind under the effect of the sliding shaft. From FIG. 7, it is known that the front-end displacement of shelter unit 31 of the second detecting unit is larger than the displacement of the second sensor 4, i.e. S2>S1. At this time, one end of the shelter unit 31 goes through the response position of the second sensor 4, not preventing the light of the second sensor 4 from reaching the reception unit of the second sensor 4 any more, under which circumstance the light path of the second sensor 4 is connected as FIG. 5; the light from the emission unit of the first sensor 2 is sheltered by the first detecting unit 1 and the light path of the first sensor 2 is under disconnection state. With the installation progress of the cartridge in the printer, the front-end protective cover 21 continues to move in the opposite direction. Light is emitted from the emission unit of the second sensor 4. The shelter unit 31 has currently reached the limiting position, permitted no more displacement. The second sensor 4 continues to move until its light is sheltered again by the shelter unit 31 and prevented from returning to the reception unit of the second sensor 4, under which circumstance the light path of the second sensor 4 is disconnect. The light from the emission unit of the first sensor 2 is still be sheltered by the first detecting unit 1 and the light path of the first sensor 2 is under disconnection state shown as FIG. 6. The printer then gives a prompt that the installation of the cartridge is completed.

Embodiment 2

Figure 9:
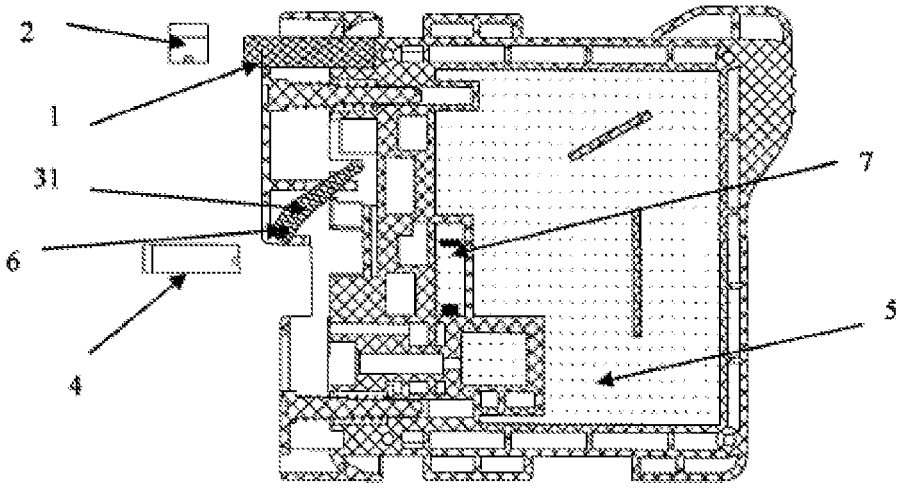
FIG. 9 illustrates a structural diagram for the cartridge of embodiment 2 of the invention.
Figure 10:
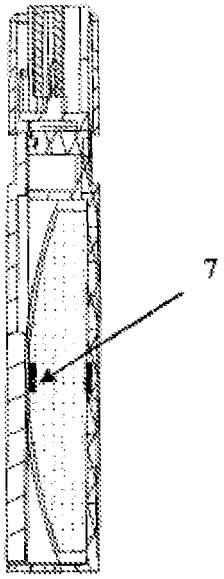
FIG. 10 illustrates a status diagram of the trigger switch set on the side of ink storage cavity when there's ink.
Figure 11:
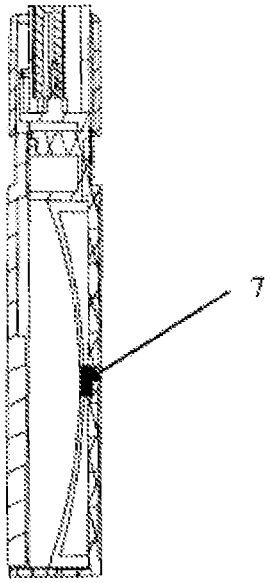
FIG. 11 illustrates a status diagram of the trigger switch set on the side of ink storage cavity when there's no ink.

FIG. 9 shows a cartridge for ink-jet printer, comprising a cartridge body 20, a protective cover 21 moving relatively to the cartridge body under pressure, a detection mechanism for cartridge and a detection mechanism for remaining ink volume, wherein the cartridge body 20 includes an ink storage cavity 5, an ink outlet for providing ink to the printer head and an air inlet, the detection mechanism of cartridge is the same as that of embodiment 1 and the detection mechanism for remaining ink volume includes a trigger switch 7 set at the bottom of the ink cavity 5 and a lamp 6 connected in series with the trigger switch 7, of which the said lamp 6 is set on the side of the shelter unit 31 near the second sensor and connects with the power supply, and the said trigger switch 7 is in disconnection when there's ink and in connection when there's no ink. Of course, the position of the lamp 6 is not limited to the shelter unit and can be any position as long as its light can be received by the reception unit of the second sensor to make the light path of the second sensor be in connection status. After the installation detection of the printer described as embodiment 1, ink volume is reduced with the operation of the printer and the lamp switch 6 will be triggered to make lamp 6 emit light when there's no ink, wherein light is received by the reception unit of the second sensor 4 and under which state the second sensor 4 is in connection. The printer gives a prompt to change cartridge due to no ink. The trigger switch 7 can also be set on both sides of the ink storage cavity, one side having elasticity. The side with elasticity stretches to turn off the trigger switch 7 under the effect of ink when there's ink shown as FIG. 10 and retracts to turn on the trigger switch 7 when there's no ink shown as FIG. 11.

Embodiment 3

Figure 12:
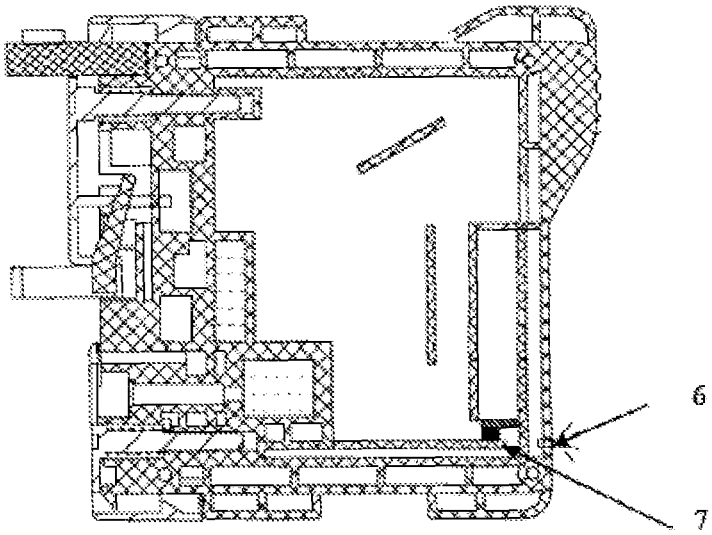
FIG. 12 illustrates a structural diagram for the cartridge using light alarming of embodiment 3 of the invention.
Figure 13:
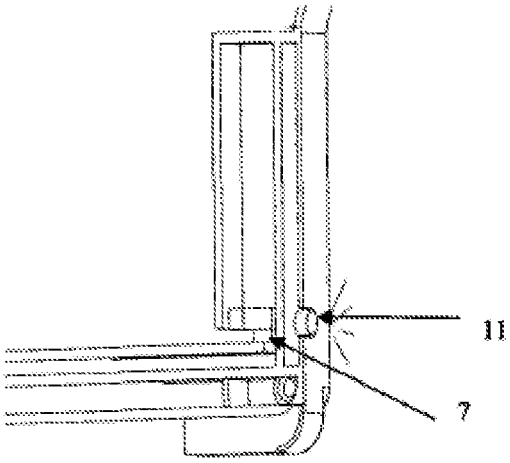
FIG. 13 illustrates a structural diagram for the cartridge using audio alarming of embodiment 3 of the invention.

FIG. 12 shows a cartridge for ink-jet printer, comprising a cartridge body 20, a protective cover 21 moving relatively to the cartridge body under pressure, a detection mechanism for cartridge and a detection mechanism for remaining ink volume, wherein the cartridge body 20 includes an ink storage cavity 5, an ink outlet for providing ink to the printer head and an air inlet, the detection mechanism of cartridge is the same as that of embodiment 1 and the detection mechanism for remaining ink volume includes a trigger switch 7 set at the bottom of the ink cavity and a lamp 6 connected in series with the trigger switch 7, of which the said lamp 6 is set at exposed position after the installation of the cartridge and connects with the power supply, the said trigger switch 7 is in disconnection when there's ink and in connection when there's no ink, and the lamp 6 can be replaced as FIG. 13 to change the light alarming with audio alarming. After the installation detection of the printer described as embodiment 1, ink volume is reduced with the operation of the printer and the lamp 6 or the loudspeaker 11 switch will be triggered to alarm to change cartridge when there's no ink. The trigger switch 7 can also be set on both sides of the ink storage cavity, one side having elasticity. The side with elasticity stretches to turn off the trigger switch 7 under the effect of ink when there's ink shown as FIG. 10 and retracts to turn on the trigger switch 7 when there's no ink shown as FIG. 11.

Embodiment 4

Figure 14:
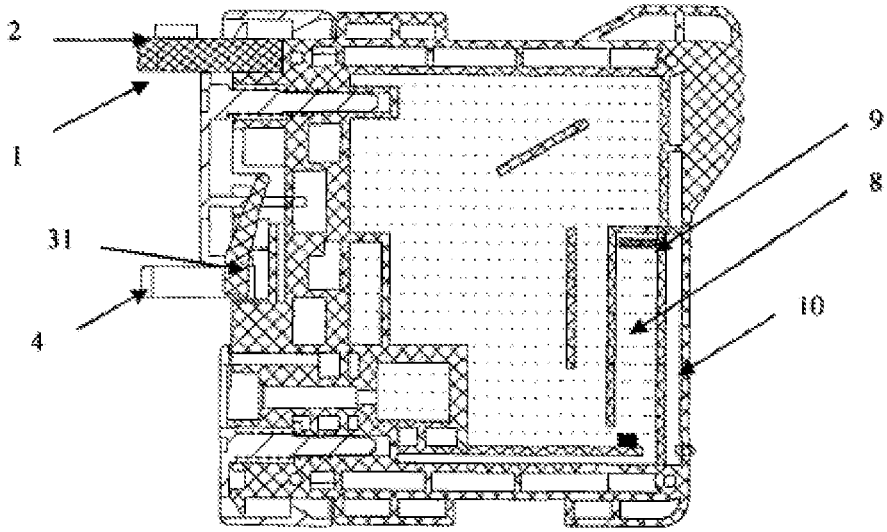
FIG. 14 illustrates a structural diagram for the cartridge of embodiment 4 of the invention.

FIG. 14 shows a cartridge for ink-jet printer, comprising a cartridge body 20, a protective cover 21 moving relatively to the cartridge body under pressure, a detection mechanism for cartridge and a detection mechanism for remaining ink volume, wherein the cartridge body 20 includes an ink storage cavity 5, an ink outlet for providing ink to the printer head and an air inlet, the detection mechanism of cartridge is the same as that of embodiment 1, and the said detection mechanism for remaining ink volume includes a cavity made of transparent material and connecting with the ink storage cavity 5, of which a movable detecting unit 9 floating in the ink is set in the cavity and a mark 10 showing ink volume is set on the transparent wall of the cavity 8. After the installation detection of the printer described as embodiment 1, ink volume is reduced with the operation of the printer. Ink volume can be shown through the movable detecting unit 9 varying with ink volume and the ink volume mark 10 outside the cavity 8 to detect remaining ink volume and give a prompt for changing cartridge.

In addition, the detection mechanism for remaining ink volume in embodiment 3 and 4 can be used together to observe remaining volume and give alarms for no ink, more convenient to users' detection for remaining ink volume.

What is claimed is:

1. A cartridge for ink-jet printer comprising a cartridge body, a protective cover moving relatively to the cartridge body under pressure, a detection mechanism for detecting cartridge installation and a detection mechanism for detecting remaining ink volume, the cartridge body including an ink storage cavity, wherein the detection mechanism for detecting cartridge installation includes first and second detecting units respectively matching to first and second sensors on the printer, the second detecting unit includes a shelter unit, a fixed shaft set on the cartridge body, a sliding shaft on the protective cover and a reset unit of the shelter unit, wherein the shelter unit connects with the fixed shaft and the shelter unit rotates around the fixed shaft under the pressure of the sliding shaft and resets together with the protective cover under the effect of the reset unit of the shelter unit.

2. The cartridge for ink-jet printer of claim 1, wherein the reset unit of the shelter unit is a shifting chute of the sliding shaft set on the shelter unit.

3. The cartridge for ink-jet printer of claim 1, wherein the detection mechanism for detecting remaining ink volume includes a trigger switch set within the cartridge body and a lamp connected in series with the trigger switch, the lamp is set in the space near a reception unit of the second sensor and connects to a power supply and the trigger switch is in disconnection when there's ink and in connection when there's no ink.

4. The cartridge for ink-jet printer of claim 3, wherein the trigger switch is set at the bottom of the ink storage cavity.

5. The cartridge for ink-jet printer of claim 3, wherein the trigger switch is set on both sides of the ink storage cavity, one side has elasticity, stretching to turn off the trigger switch when there's ink and retracting to turn on the trigger switch when there's no ink.

6. The cartridge for ink-jet printer of claim 1, wherein the detection mechanism for detecting remaining ink volume includes a trigger switch set in the cartridge body and an alarming mechanism connected in series with the trigger switch, the alarming mechanism connects with a power supply and the trigger switch is in disconnection when there's ink and in connection when there's no ink.

7. The cartridge for ink-jet printer of claim 6, wherein the trigger switch is set at the bottom of the ink storage cavity.

8. The cartridge for ink-jet printer of claim 6, wherein the trigger switch is set on both sides of the ink storage cavity, one side has elasticity, stretching to turn off the trigger switch when there's ink and retracting to turn on the trigger switch when there's no ink.

9. The cartridge for ink-jet printer of claim 1, wherein the detection mechanism for remaining ink volume includes a cavity made of transparent material and connected with the ink storage cavity.

* * * * *